US011077538B2

(12) United States Patent
Lares

(10) Patent No.: US 11,077,538 B2
(45) Date of Patent: Aug. 3, 2021

(54) TORQUE RETAINING APPARATUS AND METHOD OF PRODUCTION

(71) Applicant: Cold Heading Company, Warren, MI (US)

(72) Inventor: Alan M. Lares, Peasant Ridge, MI (US)

(73) Assignee: COLD HEADING COMPANY, Warren, MI (US)

( * ) Notice: Subject to any disclaimer, the term of this patent is extended or adjusted under 35 U.S.C. 154(b) by 337 days.

(21) Appl. No.: 16/220,889

(22) Filed: Dec. 14, 2018

(65) Prior Publication Data

US 2019/0184530 A1 Jun. 20, 2019

Related U.S. Application Data

(60) Provisional application No. 62/598,887, filed on Dec. 14, 2017.

(51) Int. Cl.

| | |
|---|---|
| ***B25B 23/10*** | (2006.01) |
| ***B25B 13/06*** | (2006.01) |
| ***B25B 13/48*** | (2006.01) |
| ***B25B 23/00*** | (2006.01) |

(52) U.S. Cl.

CPC ..... *B25B 23/10* (2013.01); *B25B 13/06* (2013.01); *B25B 13/481* (2013.01); *B25B 23/0085* (2013.01); *B25B 23/108* (2013.01)

(58) Field of Classification Search

CPC ..... B25B 13/06; B25B 13/481; B25B 23/108; B25B 23/0085; B25B 23/10; B25B 23/0035

See application file for complete search history.

(56) References Cited

U.S. PATENT DOCUMENTS

| | | | | |
|---|---|---|---|---|
| 2,800,822 A * | 7/1957 | Allred | B25B 13/06 81/125 |
| 4,284,114 A | 8/1981 | Korenobu | |
| 4,734,001 A * | 3/1988 | Bennett | F16B 39/10 411/119 |
| 4,820,096 A | 4/1989 | Knight | |
| 4,906,150 A * | 3/1990 | Bennett | F16B 39/10 411/119 |
| 5,954,466 A * | 9/1999 | Coffey | B25B 27/16 411/119 |
| 6,077,014 A | 6/2000 | Gulistan | |
| 6,796,907 B2 * | 9/2004 | McGuire | F16B 37/00 411/169 |
| 7,765,898 B2 * | 8/2010 | Sakaguchi | B25B 23/10 81/60 |

(Continued)

*Primary Examiner* — David B. Thomas

(74) *Attorney, Agent, or Firm* — Dickinson Wright, PLLC

(57) ABSTRACT

A torque retaining device for preventing unitary rotation of a nut and a fastener extending through two parts to be connected is provided. The torque retaining device includes an engagement portion for connection to one of the nut and a fastener head and an elongated portion for rotationally catching on one of the parts that the fastener is to be extended through. The engagement portion includes a wall having an inner side that defines a cavity for placement of the fastener head or nut and is shaped rotate with the fastener head or nut. At least one flexible member extends radially inwardly from the inner side of the wall for holding the fastener head or nut in the engagement portion.

17 Claims, 16 Drawing Sheets

(56) References Cited

U.S. PATENT DOCUMENTS

| | | | | |
|---|---|---|---|---|
| 8,069,754 | B2 * | 12/2011 | Elgin | B25B 23/10 81/125 |
| 9,447,811 | B2 * | 9/2016 | Stewart | F16B 39/10 |
| 2013/0212862 | A1 * | 8/2013 | Sleath | F01D 25/285 29/525.01 |
| 2019/0275649 | A1 * | 9/2019 | Nakagawa | B25B 23/106 |

* cited by examiner

TORQUE RETAINING APPARATUS AND METHOD OF PRODUCTION

CROSS REFERENCE TO RELATED APPLICATION

This application claims priority to and the benefit of U.S. provisional patent application Ser. No. 62/598,887 filed Dec. 14, 2017, the disclosure of which is incorporated herein by reference in its entirety.

BACKGROUND OF THE INVENTION

1. Field of the Invention

The present disclosure relates generally to a torque retaining device. More particularly, the present disclosure relates to a torque retaining device for preventing unitary rotation of a nut and fastener.

2. Related Art

This section provides background information related to the present disclosure which is not necessarily prior art.

The joining of parts, particularly during the construction of mechanical assemblies, often requires the use of threaded fasteners and corresponding nuts and washers. In general, fasteners are placed through corresponding pre-drilled holes of at least two parts to form a joint. While the pre-drilled holes can be threaded and attached directly to the fastener, this is generally avoided, as threaded surfaces have a tendency of being stripped. Therefore, the joining of parts is typically achieved via clamping by relative rotation of the fastener and nut. Fasteners offer a low tech and simplified solution over other types of fastening means, such as welding, and also allow later removal. However, certain types of joints can be difficult to assemble with fasteners. Because the fastener rotates with respect to the nut, either the nut or fastener needs to be rotationally held in place while the other is rotated, otherwise unitary rotation prevents tightening. It becomes increasingly difficult to tighten a fastener and nut in smaller spaces as access to both the nut and fastener is not always available or convenient. Likewise, where the two parts that are joined are large, it is not always feasible for one person to simultaneously reach both the nut and fastener.

In attempts to assist fastener use in these situations, certain devices have been developed for fasteners and nuts that are industrially referred to as "flag bolts" and "flag nuts." Flag bolts and flag nuts include an elongated "flag" which engages a portion of the part during fastening. This engagement prevents rotation of the attached fastener or nut and thus allows the opposite to be tightened without unitary rotation. While these flags do present development within the art, they suffer certain drawbacks. For example, flags are constructed integrally and thus can only be used once, utilize more material, and require increased tooling costs. In addition, the integral flag adds weight which is particularly problematic in the automobile industry where there is a constant effort to reduce weight. Furthermore, the flags are often times made of thin, highly corrosive metal which spreads to more expensive parts via metallic contact. Moreover, the flag has corroded, removing the fastener becomes difficult requiring extra time and tools thus increasing maintenance costs. The above issues create the risk of blossoming into improper assembly and generally slow down the assembly process.

Accordingly, there is a continuing desire to provide a torque retaining device that provides the benefits of the flag without the many shortcomings.

SUMMARY OF THE INVENTION

The subject invention provides a torque retaining device for preventing unitary rotation of a nut and a fastener extending through two parts to be connected. The torque retaining device comprises an engagement portion including a wall having an inner side defining a cavity for placement of the fastener head or nut. The inner side of the wall is shaped to rotate with the fastener head or nut. The torque retaining device further includes an elongated portion having at least one sidewall extending radially outwardly from the engagement portion for rotationally catching on one of the parts that the fastener is to be extended through. At least one flexible member extends radially inwardly from the inner side of the wall for holding the fastener head or nut in the cavity of the engagement portion.

In another aspect of the present disclosure, the subject invention further provides a torque retaining system for preventing unitary rotation of a nut and a fastener extending through two parts to be connected. The system comprises a fastener head having an exterior surface that defines an indentation extending radially inwardly. A torque retaining device is also included and comprises an engagement portion and an elongated portion. The elongated portion extends radially outwardly from the engagement portion for rotationally catching on one of the parts that the fastener is to be extended through. The engagement portion includes a wall that has an inner side defining a cavity for engagement with the exterior surface of the fastener head. The inner side of the wall being shaped to rotate with the fastener head. At least one flexible member extends radially inwardly from the inner side of the wall into the indentation of the fastener head for holding the fastener head in the engagement portion.

In yet another aspect of the present disclosure, the subject invention further provides a torque retaining device for preventing unitary rotation of a nut and a fastener extending through two parts to be connected. The torque retaining device has an engagement portion that includes a wall having an inner side defining a cavity for placement of the fastener head or nut. The inner side of the wall is shaped to rotate with the fastener head or nut. At least one flexible member extends radially inwardly from the inner side of the wall for holding the fastener head or nut in the engagement portion. The flexible member includes an arm extending to an angled cam surface for effectuating radial outward flexing of the arm as the cam surface engages the fastener head or nut.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENT

Example embodiments will now be described more fully with reference to the accompanying drawings. In general, the subject embodiments are directed to a torque retaining device that prevents a nut and fastener from simultaneously rotating during the tightening of the fastener during the connection of two parts. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the views, the torque retaining device is shown to ease workability with fasteners in tight spaces. As it will be appreciated with further reading, the torque retaining device prevents unitary rotation of a nut and fastener without the drawbacks associated with the prior art. More particularly, the torque retaining device includes a holding mechanism that allows removal of the torque retaining device from the fastener or nut once the two parts are tightened enough to prevent unitary rotation.

Figure 1:
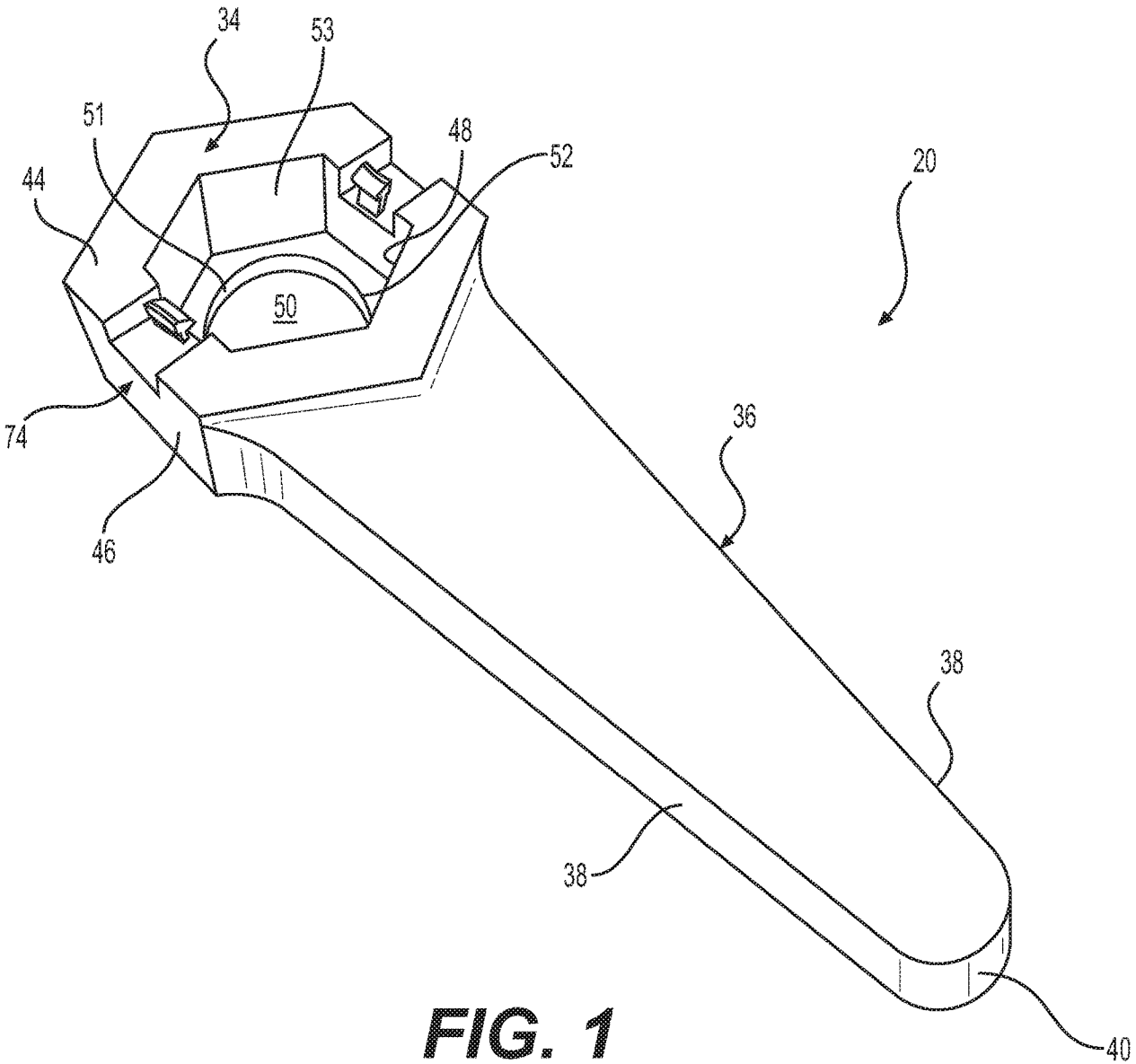
FIG. 1 is a perspective view of a torque retaining device in accordance with an aspect of the present disclosure.
Figure 2:
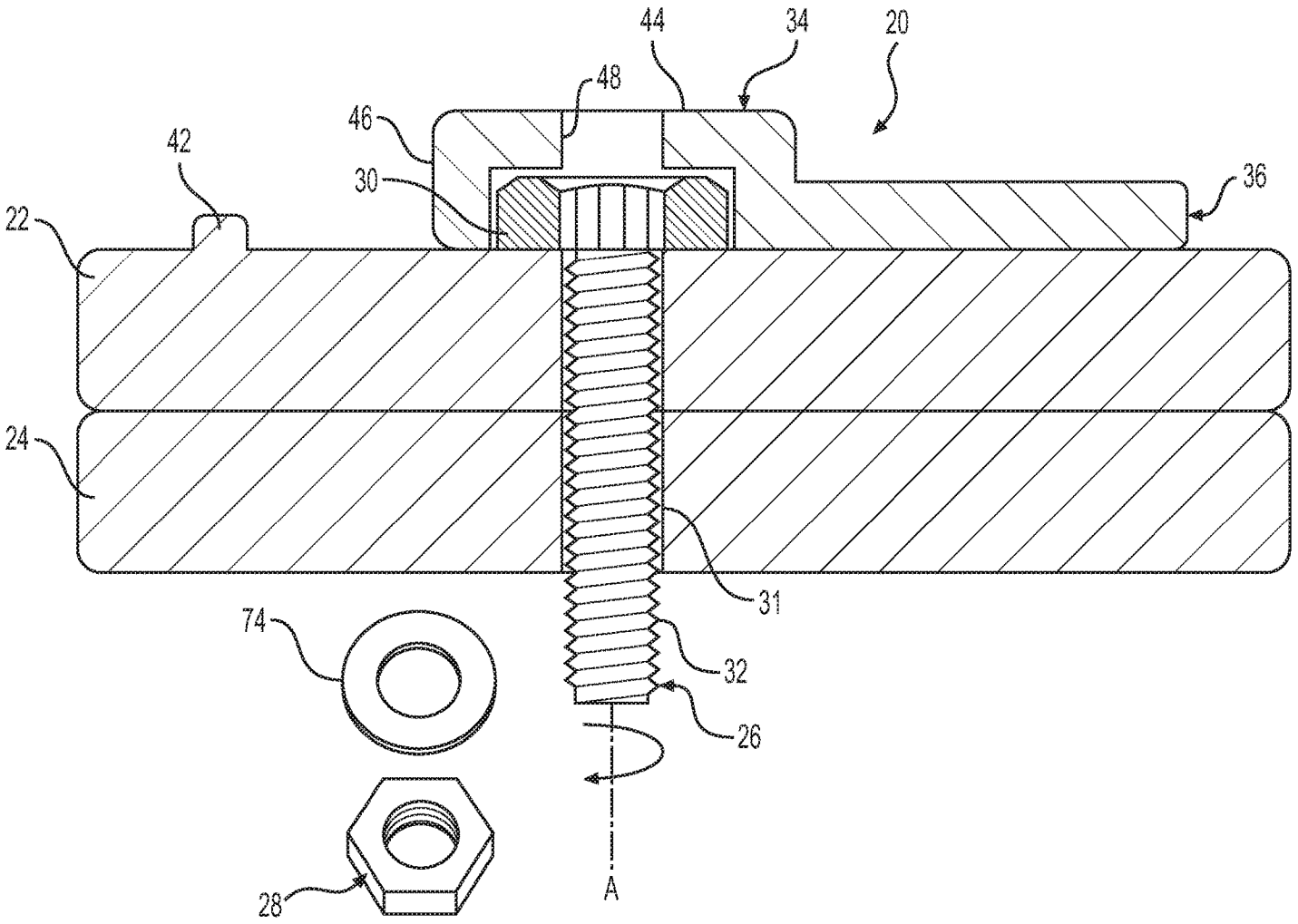
FIG. 2 is a cross-sectional view of a fastener extending through a first and second part and the torque retaining device attached to the fastener.

FIGS. 1 and 2 illustrate a torque retaining device 20 for assisting the connection of two parts 22, 24 with a fastener 26 and a nut 28. The fastener 26 includes a fastener head 30 and a fastener body 32 that is at least partially threaded and extends about a rotational axis A. Each part 22, 24 includes a pilot bore 31 that the fastener body 32 extends through. After the fastener body 32 is placed through the pilot bores 31, the nut 28 is threaded onto the fastener body 32. For purposes of illustration, the torque retaining device 20 is connected to the fastener head 30, however, it should be appreciated that the torque retaining device can also be attached to the nut 28. Likewise, the fastener head 30 is illustrated as having a hexagonal head, however, the fastener head 30 could have any number of shapes and the torque retaining device 20 can be configured to connect to the numerous types of fastener heads 30.

The torque retaining device 20 can include an engagement portion 34 and an elongated portion 36. According to an aspect, the engagement portion 34 is used for connecting to the fastener head 30 for conjoint rotation therewith. The elongated portion 36 includes two sidewalls 38 extending towards one another radially outwardly from the engagement portion 34 to define a point 40. As the nut 28 is threaded onto the fastener 26, rotation of the fastener head 30 is prevented as the engagement portion 34 rotationally mates with one of the parts 22, 24. This rotational mating can be accomplished via friction between elements and/or one of the parts 22, 24 having a protrusion 42 that contacts the sidewall 38. As described above, preventing unitary rotation is particularly useful in instances where the parts 22, 24 are disposed in a confined space that prevents access to the fastener head 30 with a wrench and also in situations wherein it is difficult for one person to reach both the nut 28 and fastener head 30 simultaneously.

Referring specifically to FIG. 1, a perspective view of one embodiment of the engagement portion 34 is shown. The engagement portion 34 can include a wall 44 shaped to fit over the fastener head 30 or nut 28. The wall 44 includes an outer side 46 merging into the sidewalls 38 of the elongated portion 36 and an inner side 48 defining a cavity 50 for placement of the fastener head 30 or nut 28. The inner side 48 further can include a flange ring 52 extending radially inwardly functioning as an axial stop such that the cavity 50 fits over the fastener head 30 or nut 28 and the flange ring 52 allows the torque retaining device 20 to axially seat on the fastener head 30 or nut 28. The flange ring 52 extends radially inwardly to define a through hole 51 for allowing the fastener body 32 to pass therethrough in situations where the engagement portion 34 is connected to a nut 28. A connection portion 53 extends adjacent to the flange ring 52 to rotationally lock the torque retaining device 20 on the fastener head 30 or nut 28.

Figure 6A:
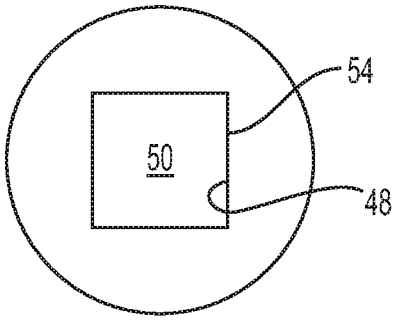
FIGS. 6A through 6G illustrate several example shapes of the engagement portion.
Figure 6B:
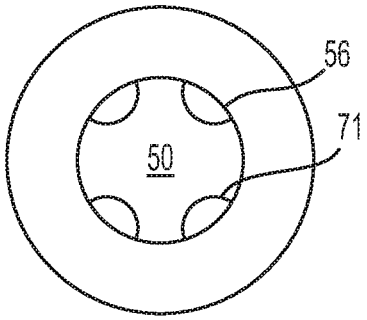
Figure 6C:
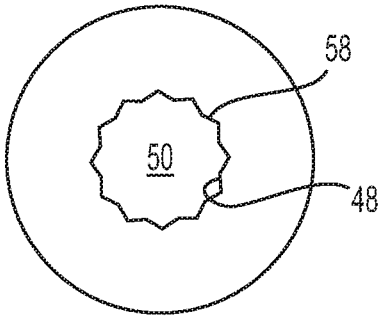
Figure 6D:
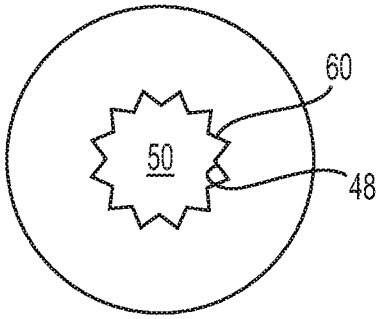
Figure 6E:
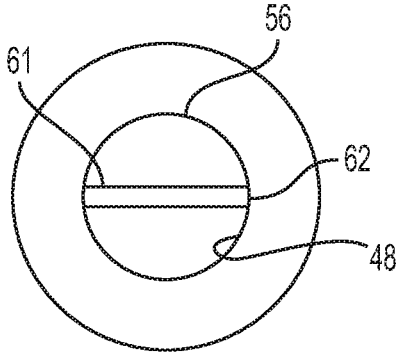
Figure 6F:
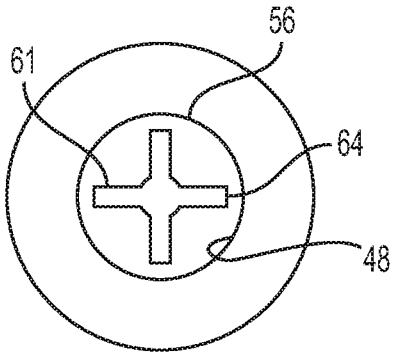
Figure 6G:
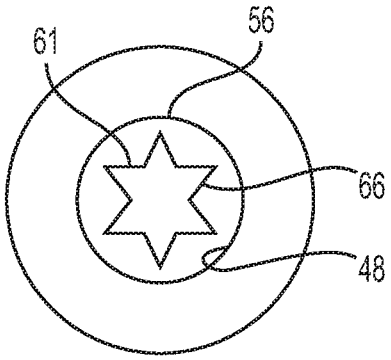

The connection portion 53 of the inner side 48 is illustrated in the above embodiment as defining a hexagonal-shape to mate with a traditional bolt-like fastener. However, the inner side 48 can define various shapes for mating with various types of fasteners and corresponding nuts. Certain non-limiting examples are shown in FIGS. 6A-6G, for example, the connection portion 53 can define a square shape 54, a circular-shape 56, a double-hex 58, a splined surface 60, etc. Moreover, the inner side 48, particularly the flange ring 52, can include one or more projections 61 for engaging with the various types of slots on fastener heads 30. For example, the projections can be slot-shaped 62, Phillips-shaped 64, torx-shaped 66, etc. In addition, the inner side 48 may also include one or more elastics pads 71 (as seen in FIG. 6B) for increased friction particularly in configurations for mating with circular and/or rounded fastener heads 30.

Figure 3:
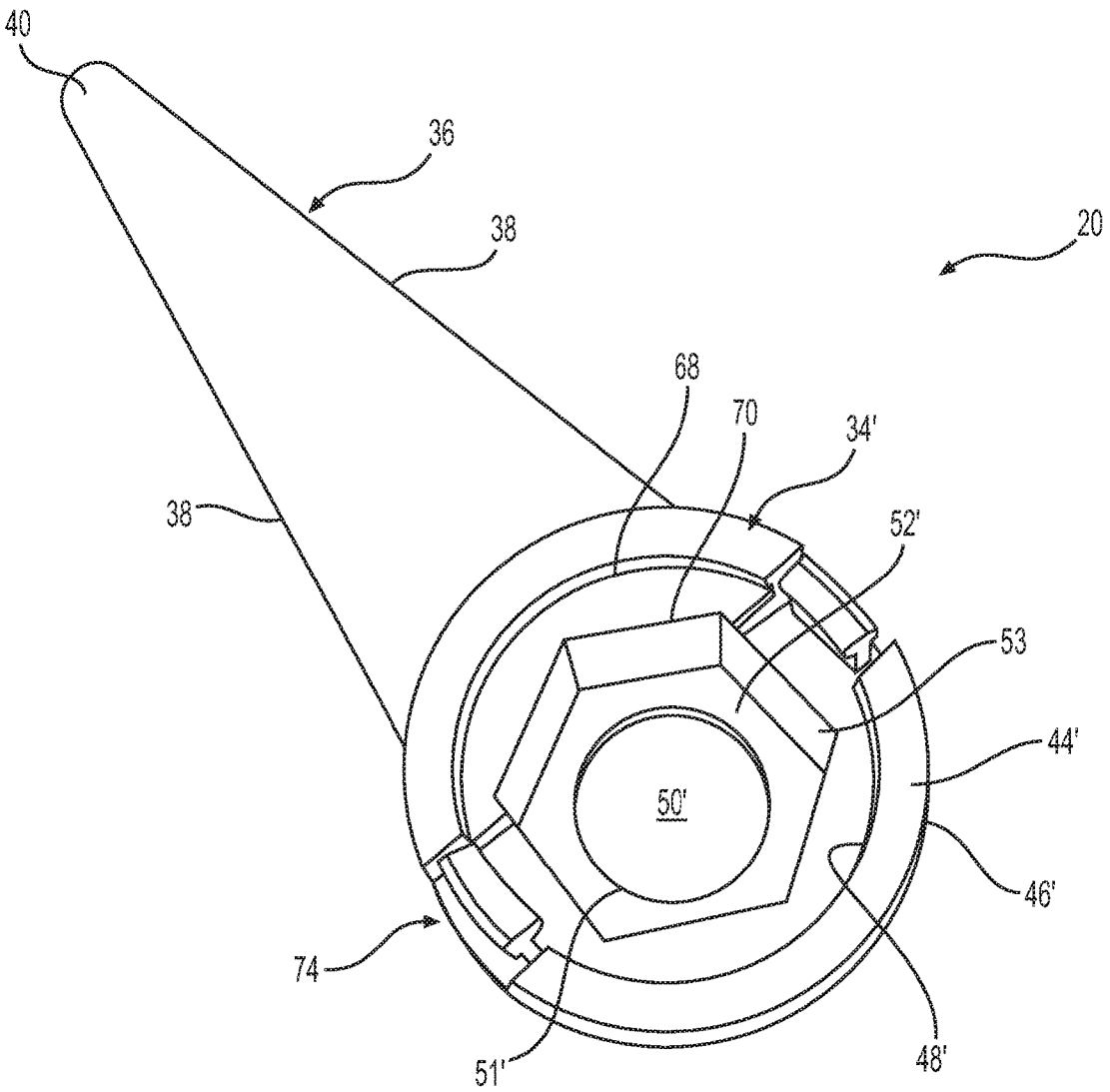
FIG. 3 is a perspective view of another embodiment of the torque retaining device in accordance with another aspect of the present disclosure.

Another embodiment of the engagement portion 34' is illustrated in FIG. 3. According to this aspect, the engagement portion 34' can include a wall 44' shaped to fit over the fastener head 30 or nut 28. The wall 44' can include an outer side 46' merging into the sidewalls 38 of the elongated portion 36 and an inner side 48' defining a cavity 50' for placement of the fastener head 30 or nut 28. The inner side 48' can include a flange ring 52' extending radially inwardly functioning as an axial stop such that the cavity 50' fits over the fastener head 30 or nut 28 and the flange ring 52' axially retains the torque retaining device 20. The flange ring 52' extends radially inwardly to define a through hole 51' for allowing the fastener body 32 to pass therethrough in situations wherein the engagement portion 34' is connected to a nut 28. The inner side 48' further can include a first step 68 and a second step 70. The first step 68 extends radially inwardly defining a circular surface 72 for accepting a washer 74 integral or disposed adjacently to the fastener head 30 or nut 28. The second step 70 terminates at the connection portion 53'.

Figure 4:
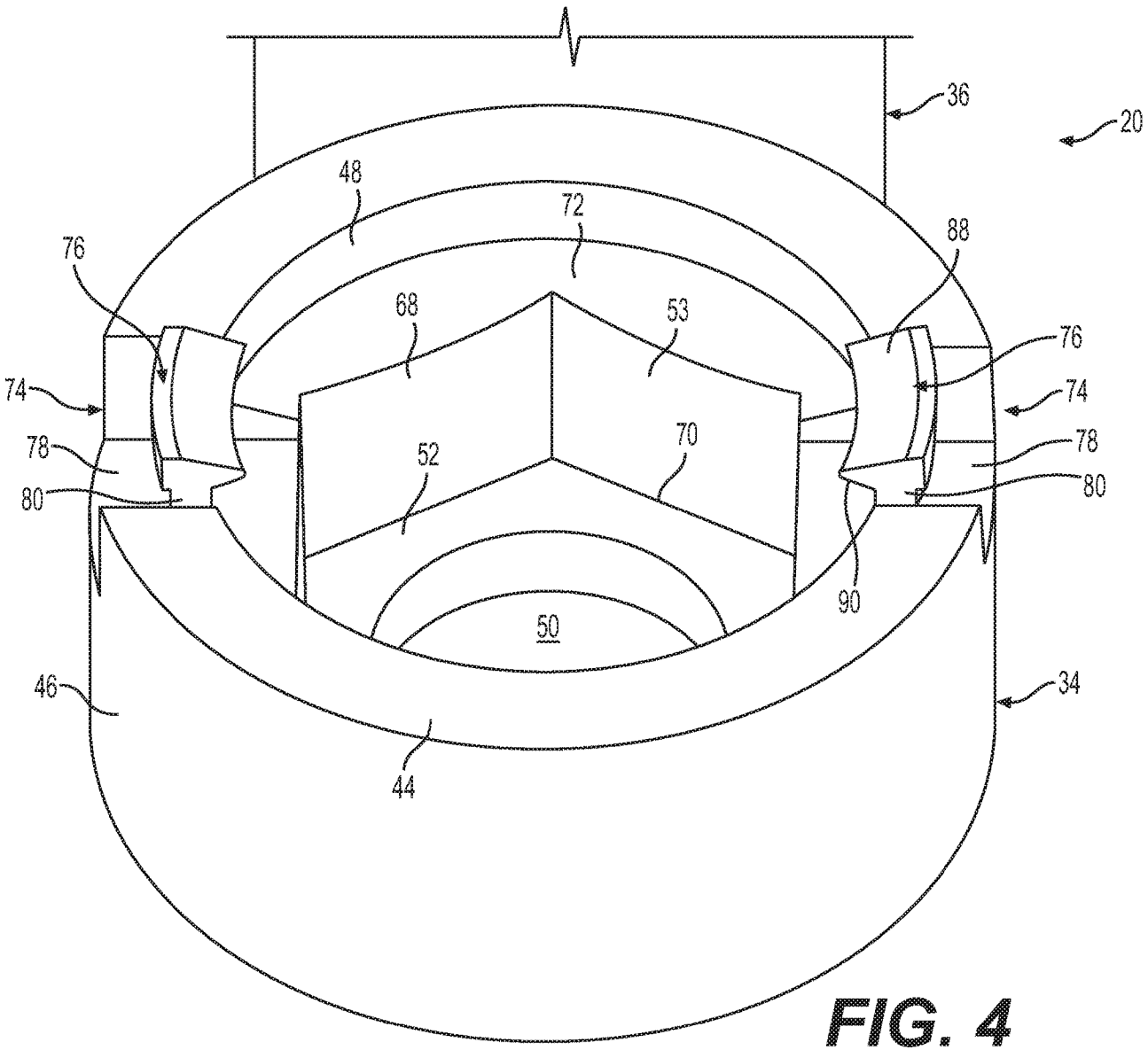
FIG. 4 is close up view of an engagement portion of the torque retaining device.
Figure 5:
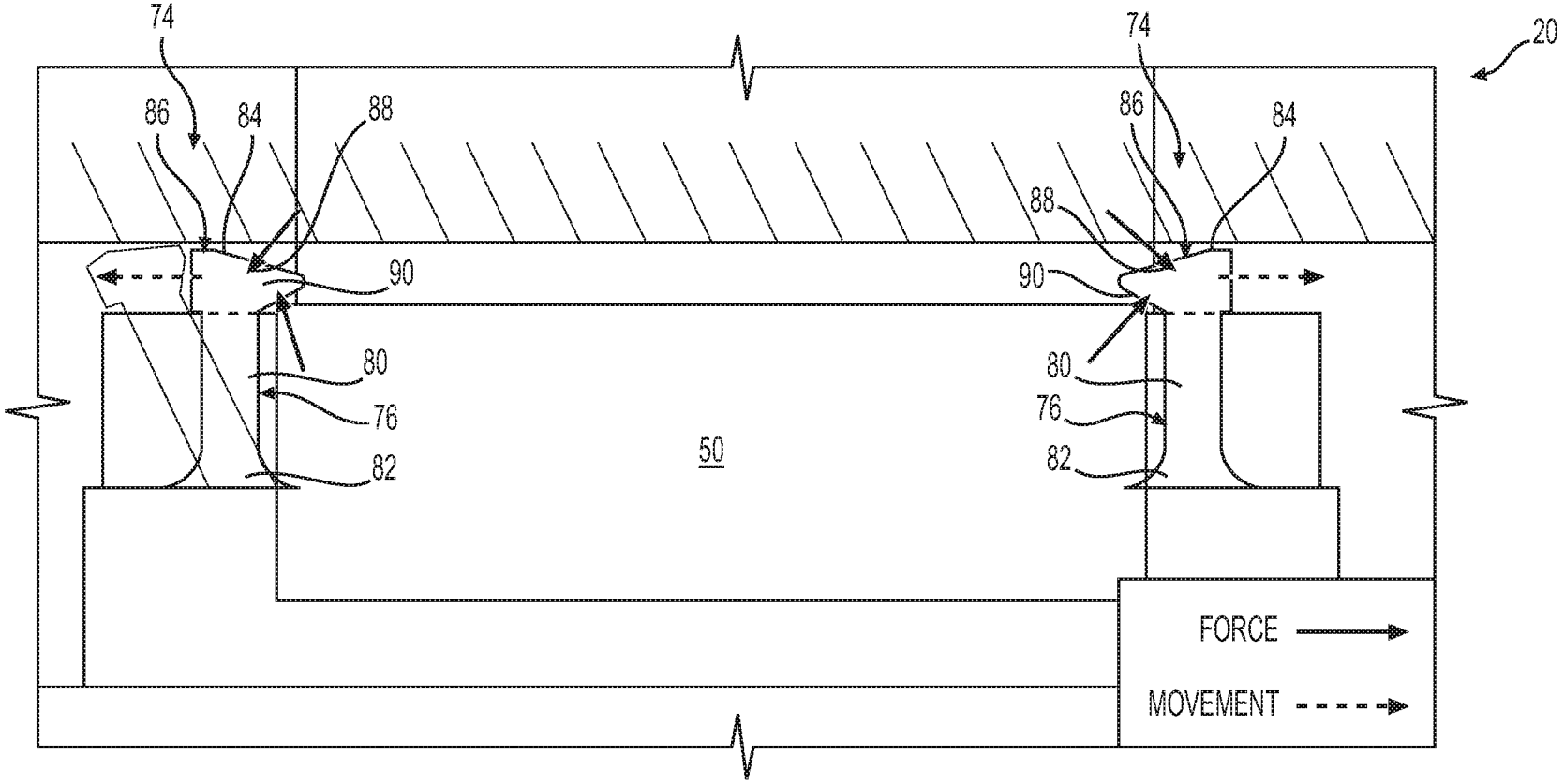
FIG. 5 is a cross-sectional view the engagement portion including a pair tabs for retaining a fastener head or nut.

As best shown in FIGS. 4 and 5, the engagement portion 34 has at least one holding mechanism 74 that can include a flexible member 76 extending at least partially radially inwardly from the inner side 48 of the wall 44. The inner side 48 of the wall 44 defines a pair of diametrically located openings 78 extending radially outwardly. The flexible members 76 are at least partially disposed in each opening 78. Each flexible member 76 can include an arm 80 having a base 82 attached to the engagement portion 36 and extending to a terminal end 84. The arm 80 is located inside the opening 78 and extends radially adjacently to the inner side 48. A retaining tab 86, having a wedge shape, is disposed on the terminal end 84 and extends radially inwardly into the cavity 50. The retaining tab 86 can comprise a first cam surface 88 and second cam surface 90. The first cam surface 88 and second cam surface 90 extend towards each other to define an angle $\alpha$. The angle $\alpha$ is preferably acute or obtuse. In operation, as the engagement portion 34 is pressed onto the fastener head 30 or the nut 22, contact with the first cam surface 88 flexes the attached arm 80 radially outwardly until the fastener head 30 or the nut 22 is substantially axially disposed in the cavity 50 wherein the retaining tabs 86 flexes back radially inwardly over the opposite side of the fastener head 30 or nut 28. Once the engagement portion 34 is locked onto the fastener head 30 or nut 28, the nut 28 is threaded onto the fastener body 32, axially drawing the fastener head 30 and nut 28 together. Upon tightening, the fastener head 30 and nut 28 press against parts 22, 24, squeezing against the cam surfaces 70, 72 of the retaining tab 86 and moving the retaining tab 86 and arm 80 back radially outwardly such that the engagement portion 34 is released from the attached fastener head 30 or nut 28.

Figure 7B:
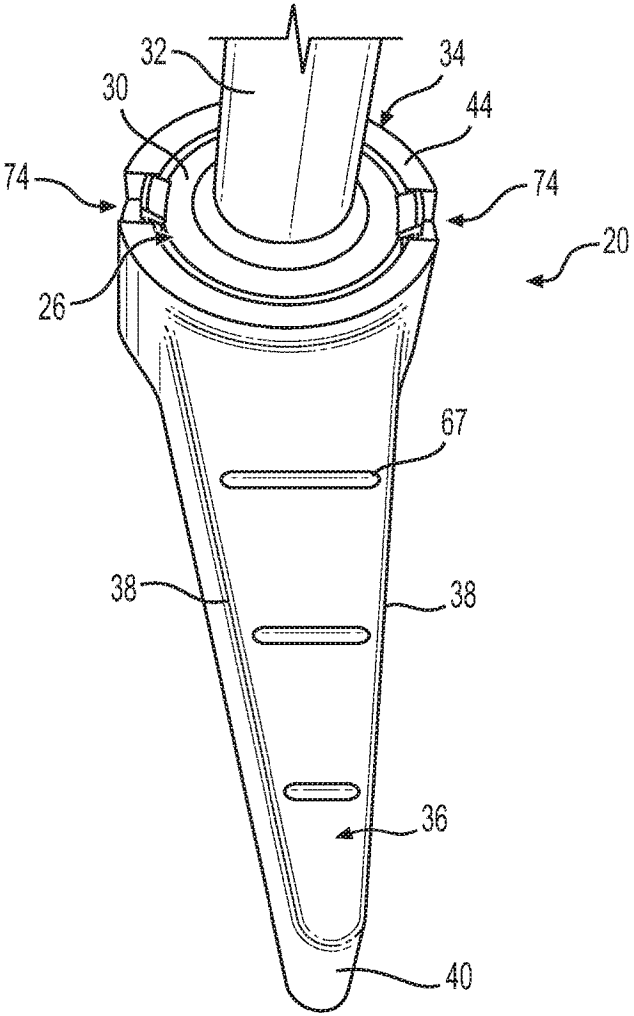
FIG. 7B is a perspective view of the torque retaining device retaining a fastener head.
Figure 7A:
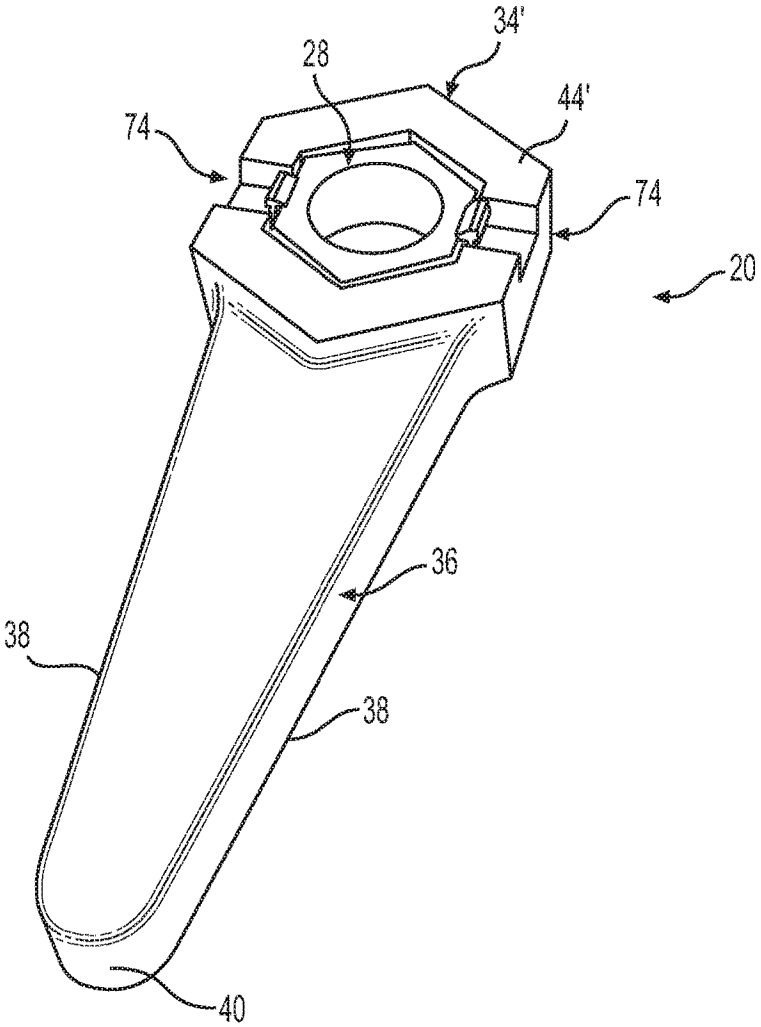
FIG. 7A is a perspective view of the torque retaining device retaining a nut.
Figure 7C:
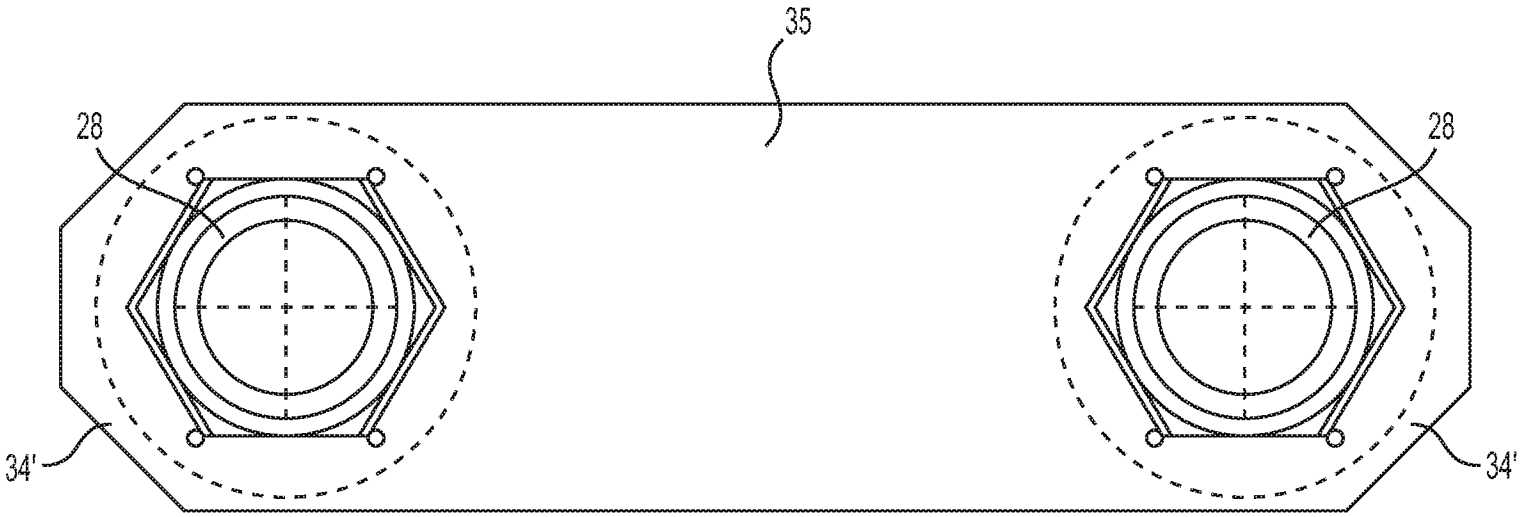
FIG. 7C is a top view of a torque retaining device retaining a pair of fastener heads and or nuts.

While it is preferable that as the arms 80 and tabs 86 are flexed out of the way, the tabs 86 can completely snap off of the fastener head 30 or nut 28. Moreover, the tabs 86 can also be spaced further or closer to the flange ring 52. In instances where the torque retaining device 20 completely snaps off of the fastener head 30 or nut 28 upon tightening, the engagement portion 34 generally either has only one flexible member 76 or the arm 80 of the flexible member 76 is rigid with low ductility. In the case of a singular flexible member 76, the tab 86 causes unequal force and thus is automatically removed upon being radially flexed outwardly during tightening of the fastener 26 and nut 28. However, it should also be appreciated that each engagement portion 34 could include any number of flexible members 76 and the flexible members 76 could take many different forms so long as they axially retain the fastener head 30 or nut 28 during tightening. FIGS. 7A and 7B illustrate the torque retaining device 20 attached to a nut 28 and fastener head 30, respectively. FIG. 7C illustrates another arrangement of the torque retaining device 20 having two engagement portions 34' spaced by a body portion 35.

Figure 8:
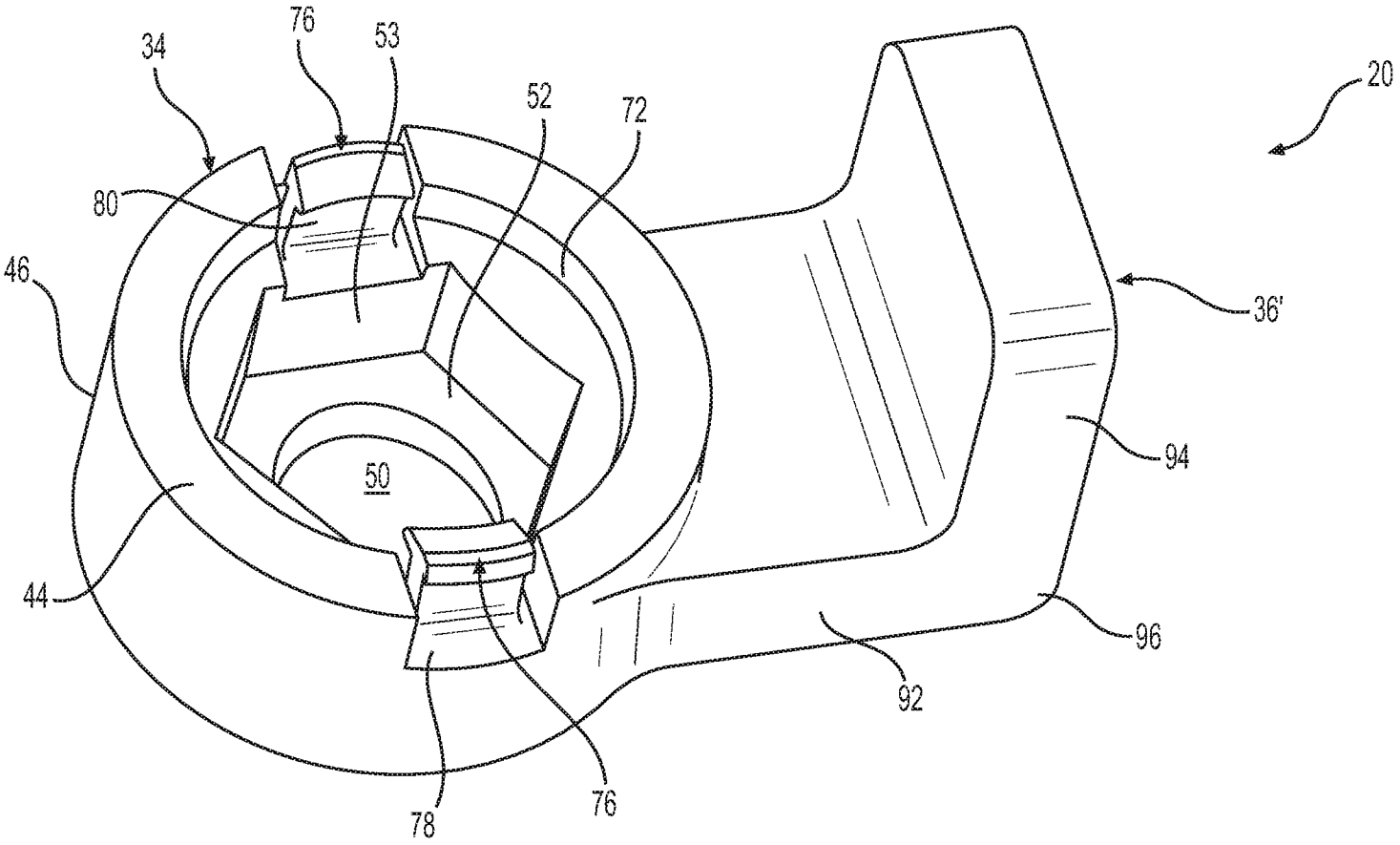
FIG. 8 is a perspective view of another embodiment of the torque retaining device in accordance with another aspect of the present disclosure.

Another embodiment of the elongated portion 36' is illustrated in FIG. 8. The elongated portion 36' of the present embodiment includes a first section 92 and a second section 94 separated by a bend 96. While not required, it is preferable that the bend 96 is a 90° angle. However, the angle could be any angle suitable for locking into one of the parts 22, 24. The elongated portion 36' of the present embodiment is particularly useful if disposed adjacent to an edge of one of the parts 22, 24, such that the bend 96 can fit over the edge. It should also be appreciated that the elongated portion 36' could take any number of suitable shapes known in the art and there could be more than one elongated portion 36' extending from the engagement portion 34, depending on the shape of the associated part 22, 24. In addition, portions of the elongated portion 36' that directly interface the part 22, 24 can include one or more friction pads 67 (as best shown in FIG. 7B) for increased friction. In one embodiment, the friction pads 67 are constructed out of a type of rubber whereas the torque retaining device 20 is constructed out a type of plastic. Moreover, the torque retaining device 20 may be packaged alone or already attached to a fastener 26. While the tabs 86 are useful during assembly of two parts 22, 24, they also serve to retain the torque retaining device 20 on fasteners 26 and nuts 28 during transportation between work sites or during shipping from a production assembly. It should also be appreciated that the friction pad 67 could be located on the engagement portion 34 and that the torque retaining device 20 may not include an elongated portion 36, 36'.

Figure 9:
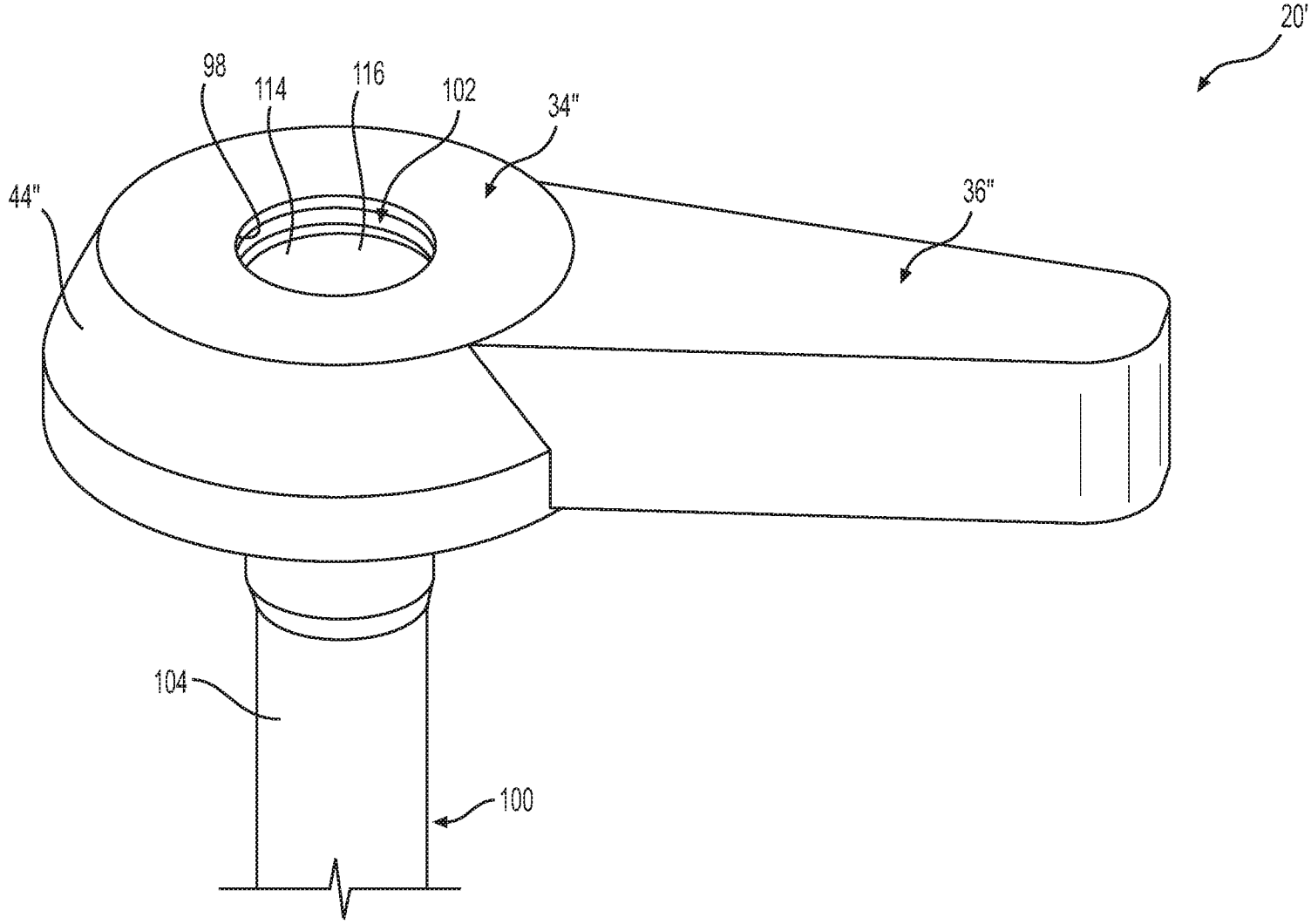
FIG. 9 is a perspective view of another embodiment of the torque retaining device for over-molding on a modified fastener head in accordance with yet another aspect of the present disclosure.

With reference now to FIG. 9, another embodiment of the torque retaining device 20' is shown. The torque retaining device 20' of the present embodiment is molded over the fastener head 30. The engagement portion 34" defines a central aperture 98 for allowing the fastener head 30 to be visible when engaged with the torque retaining device 20'. To this extent, identifying indicia about the size and/or type of fastener 26 traditionally located on the fastener head 30 is visible.

Figure 10:
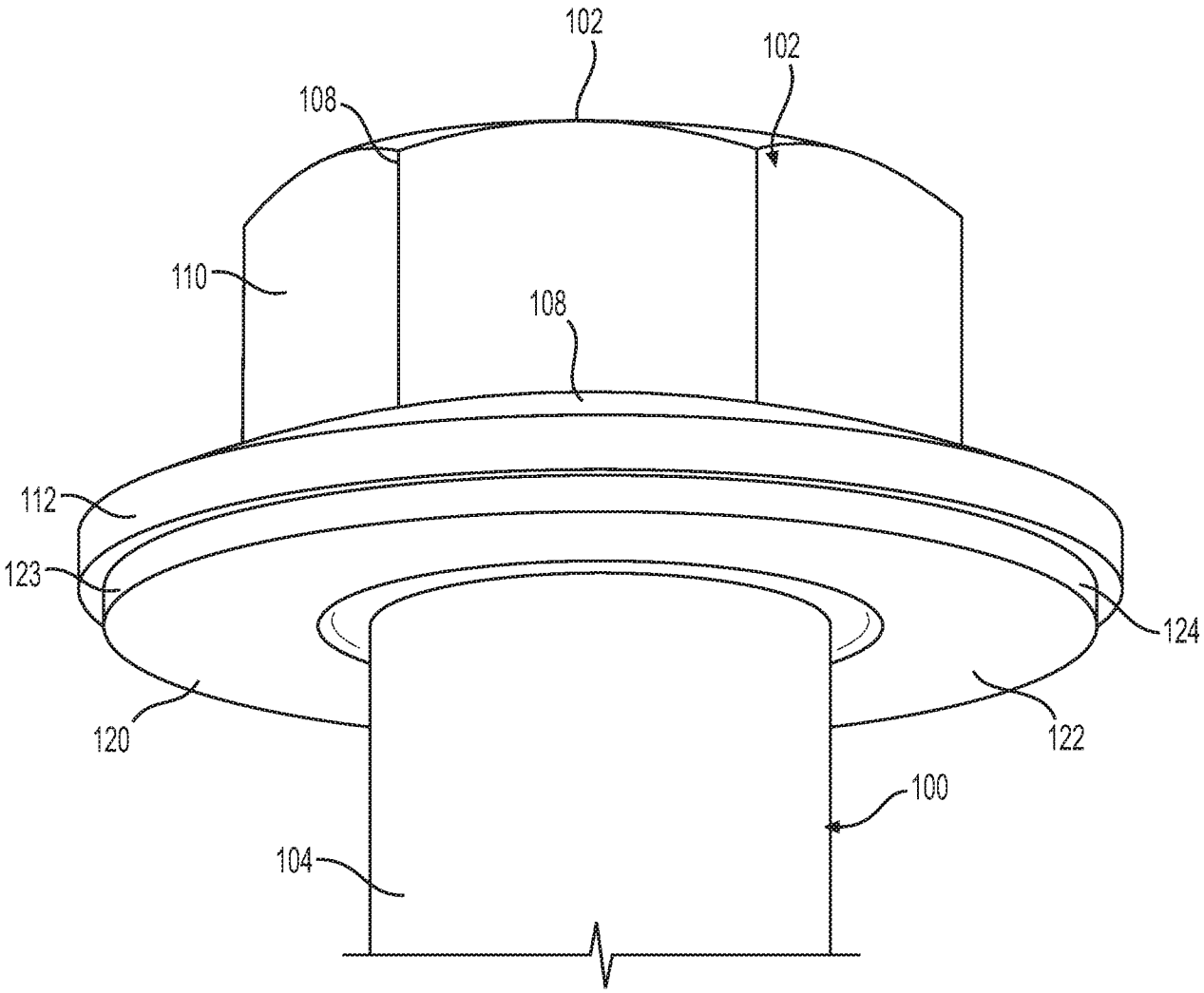
FIG. 10 is a perspective view of the modified fastener head.
Figure 11:
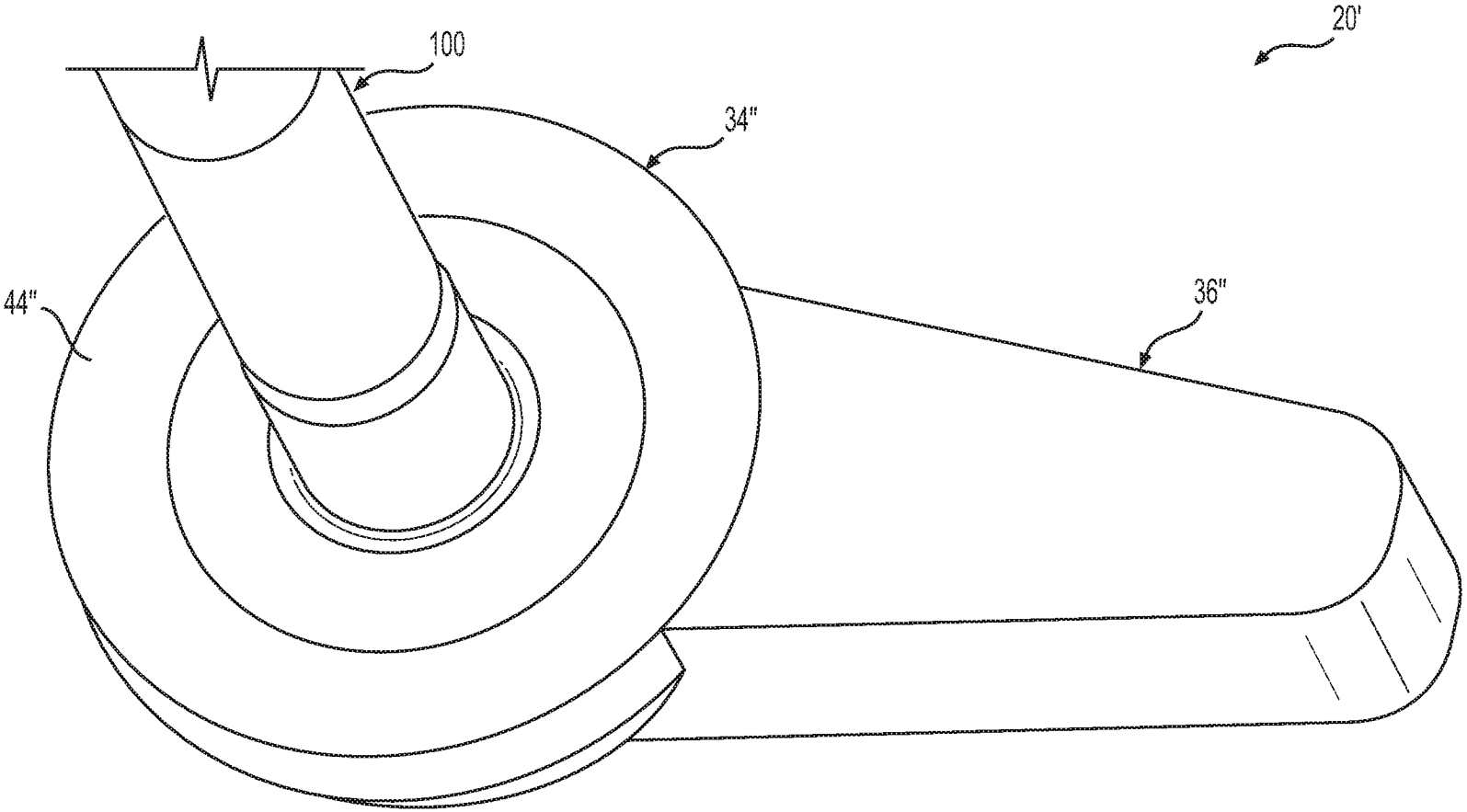
FIG. 11 is a perspective view of an underside of the modified fastener head with the over-molded torque retaining device attached thereto.

The over-molded torque retain device 20' is preferably over-molded onto an accompanying modified fastener 100 as best shown in FIG. 10. According to an aspect, the modified fastener 100 can include a modified fastener head 102 and a modified fastener body 104. The modified fastener head 102 can comprise, from a top section 106 opposite the modified fastener body 104, a tapered section 108, an interface portion 110 (such as a hexagon), and a flange 112 extending radially outwardly between the interface portion 110 and modified fastener body 104. The top section 106 can include a depression 114 that provides indicia 116 about the size and/or type of the modified fastener 100. The tapered section 108 may be angled radially outwardly from the top section 106 and extends to the interface portion 110. While the interface portion 110 is shown as a hexagon, it could any shape. The flange 112 extends radially outwardly after the interface portion 110. The flange 112 can include a top surface 118 and a bottom surface 120. The top surface 118 may be angled towards to the modified fastener body 104. The bottom surface 120 includes a bearing portion 122 for engagement with one of the parts 22, 24 as the nut 28 is tightened on the modified fastener body 104. The bottom surface 120 further can include an indentation 123 defining a stepped portion 124 that is axially offset from the bearing portion 122 that the over-molded torque retaining device 20' is molded into. The stepped portion 124 is annularly shaped about the bearing portion 122. As such, the over-molded torque retaining device 20' is preferably molded into the stepped portion 124 such that it does not extend axially past or radially over the bearing portion 122 and thus does affect connection between the bearing portion 122 and part 22, 24. However, as shown in FIG. 12B, the over-molded torque retaining device 20' can also be molded into the stepped portion 124 and include a ring projection 125 such that it extends axially past but not radially over the bearing portion 122. In operation, such an arrangement, automatically removes connection between the over-molded torque retaining device 20' and modified fastener head 102 upon tightening.

Figure 12A:
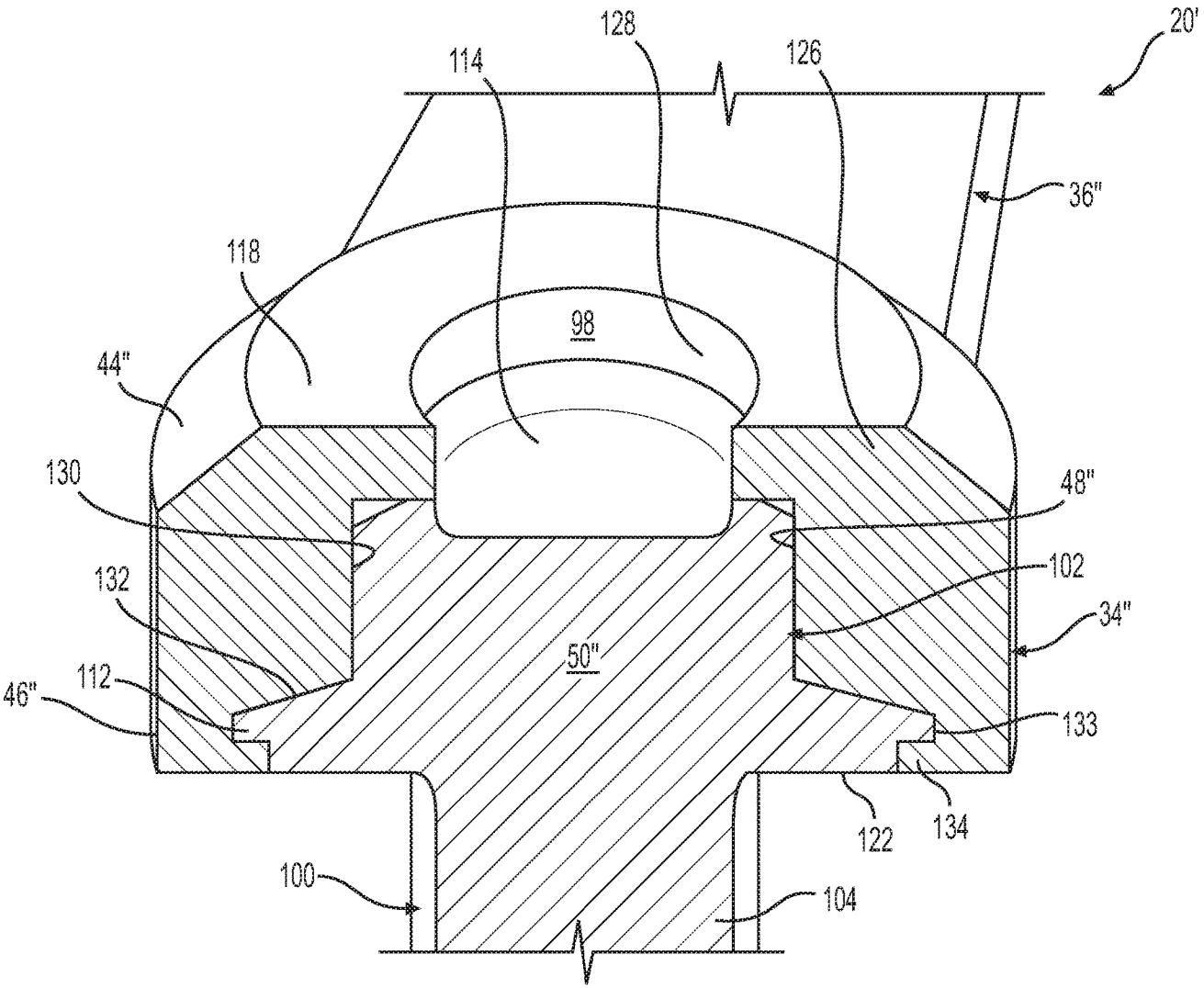
FIG. 12A is a cross-sectional view illustrating the over-molded torque retaining device molded over the modified fastener head and FIG. 12B is a cross-sectional view illustrating a modified over-molded torque retaining device.
Figure 12B:
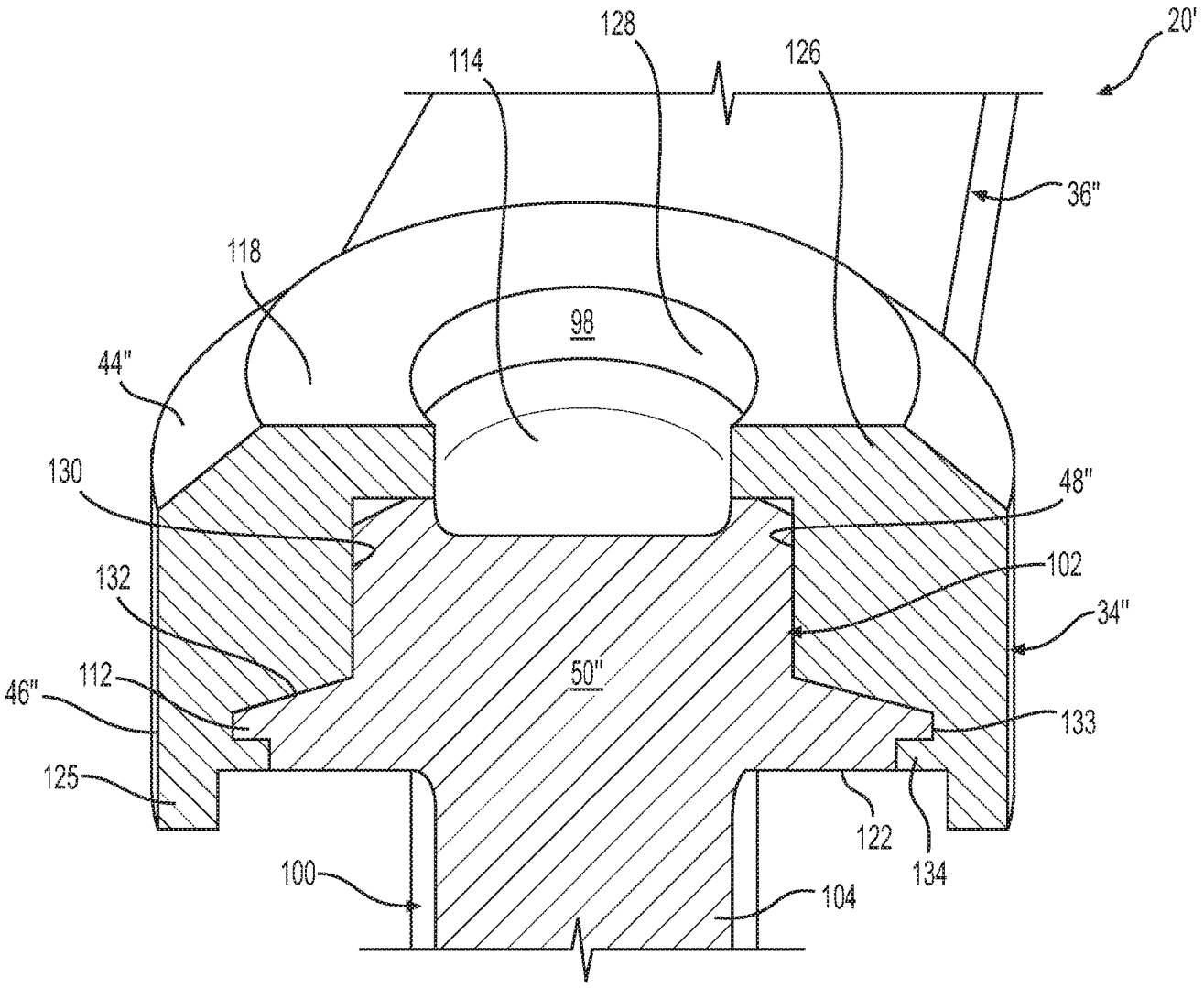

FIGS. 12A and 12B illustrate additional aspects of the over-molded torque retaining device 20'. According to an aspect, the over-molded torque retaining device 20' can include an engagement portion 34" having a wall 44" shaped to fit over the modified fastener head 102. The wall 44" includes an outer side 46" merging into the sidewalls 38" of the elongated portion 36" and an inner side 48" defining a cavity 50" for placement of the modified fastener head 102. The inner side 48" has a complementary shape to the modified fastener head 102 and can include a top ring 126 disposed over the top surface 118 that defines the central aperture 98. A first step 128 extends over the tapered section 108 and a second step 130 extends over the interface portion 110. A third step 132 extends over the top surface 118 of the flange 112. A bottom projection 133 or retaining ring 134 can extend radially inwardly into the stepped portion 124 of the flange 112. It should be appreciated that the indentation 123 of the modified fastener head 102 and the bottom projection 133 of the over-molded torque retaining device 20' can be any number of complementary shapes that mate to axially lock in the over-molded torque retaining device 20' on the modified fastener head 102.

Figure 13:
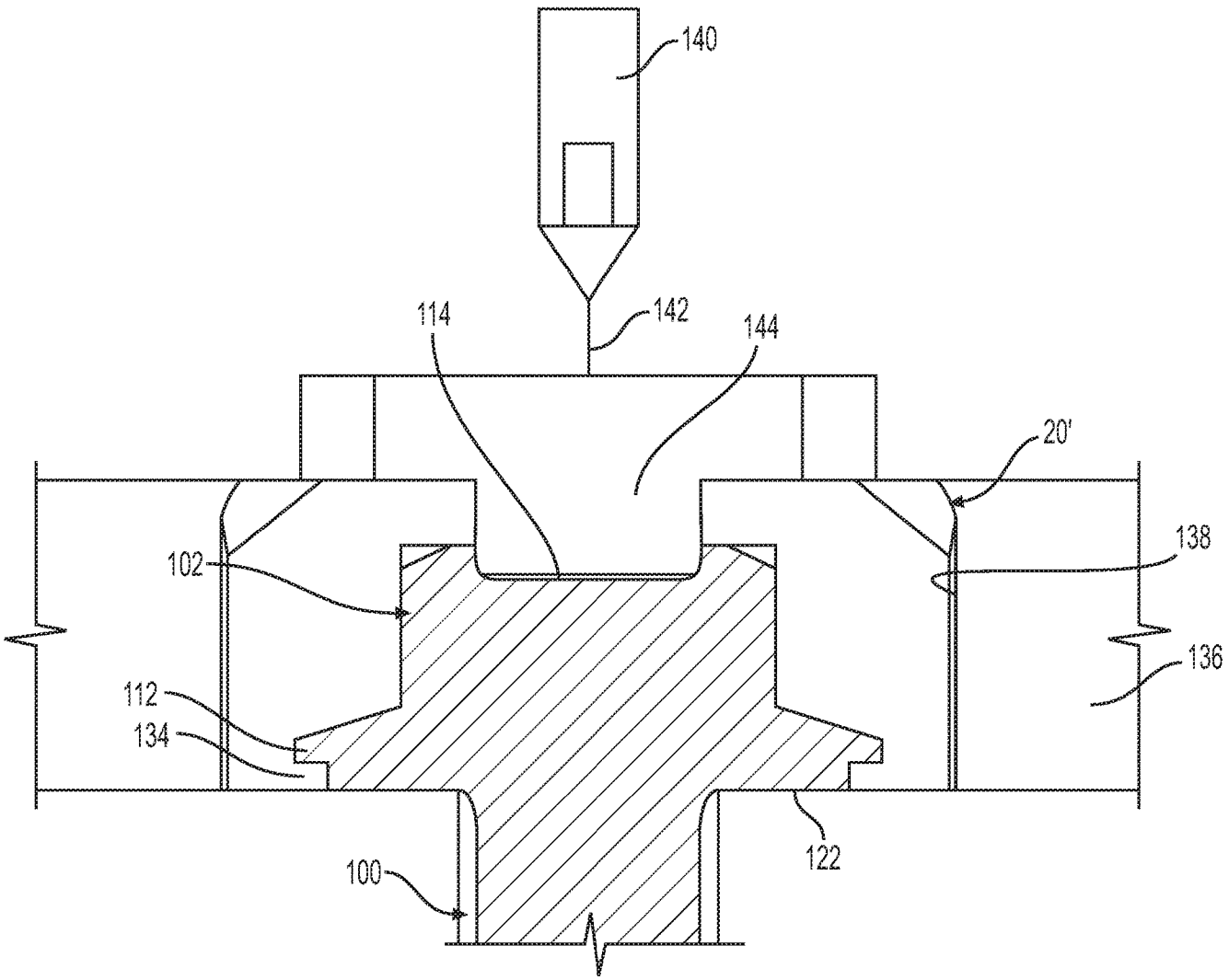
FIG. 13 is a cross-sectional view illustrating a modified fastener head substrate receiving an over-molded torque retaining device.
Figure 14:
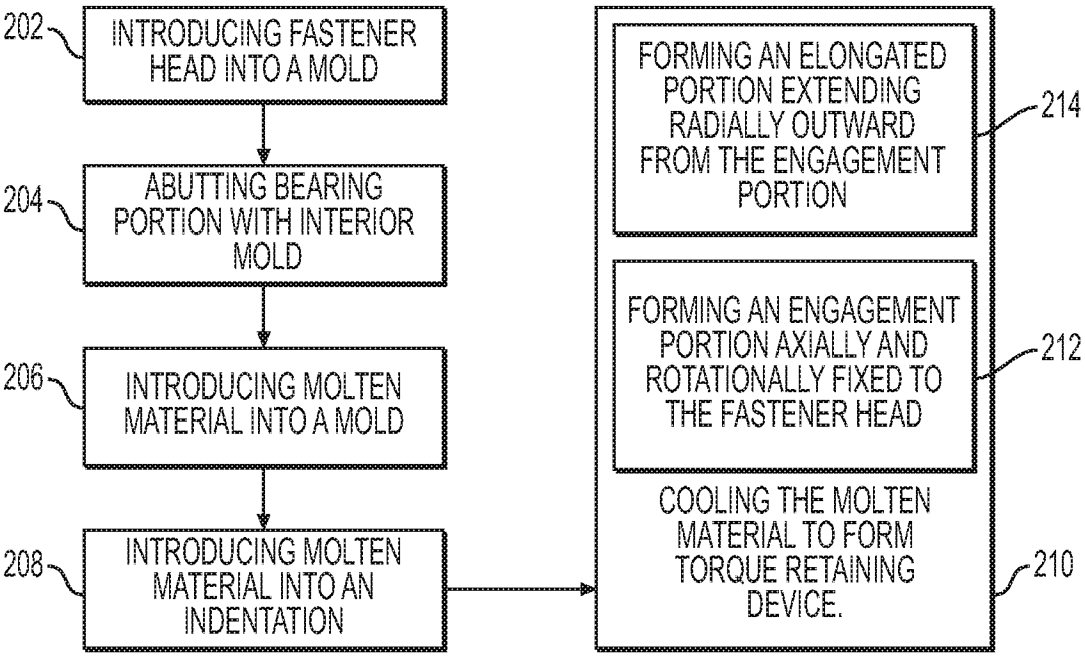
FIG. 14 is a method flow chart illustrating the steps of over-molding the torque retaining device on the modified fastener head.

A method 200 of attaching the over-molded torque retaining device 20' on the modified fastener head 102 is also provided and can include a mold 136 defining a cavity 138 that outlines the shape of the over-molded torque retaining device 20'. The modified fastener head is placed 202 within the mold such that it is impermeably sealed therein with the bearing portion abutting 204 an interior surface of the mold 136. The injector provides 206 molten material to the cavity through at least one port. While FIG. 13 only shows one mold, the process can include several molds with an injector providing molten material to the multiple molds simultaneously.

It is preferable that the molten material be a plastic base and have a relatively low melting temperature compared to the modified fastener 100 which is preferably metal. It also preferable the molten material have some elasticity for increased friction against a part 22, 24. As one example, the molten material can be rubber to allow the over-molded torque retaining device 20' to be elastically removed without breaking. However, it may also be desirable to use a more rigid material that can be broken off after use. Regardless of the molten material composition, the method preferably continues with placement 208 of molten material radially inwardly into an indentation defined by the modified fastener head. The molten material is then allowed to cool 210 until it forms into the over-molded torque retaining device. The step of forming the over-molded torque retaining device may further include forming 212 an engagement portion and forming 214 an elongated portion. The method may further include providing an indicia on the modified fastener head that relates to one of size, shape, and material. Additional, the method can include a step of providing a mold projection shaped to fit into the depression of the modified fastener head as to form a top ring defining a central aperture for allowing a user to see the indicia.

The disclosure further includes a method of joining parts 22, 24, wherein a fastener body 32 is placed into superimposed bores 31 of two parts 22, 24. The torque retaining device 20 is placed over either the fastener head 30 or the nut 28 either pre or post mating of the thread on fastener body 32 and the nut 28. The tabs 86 of the torque retaining device 20 are pressed against the fastener head 30 or nut 28 until the arms 80 of the engagement portion 34 are flexed enough to allow the fastener head 30 or nut 22 to enter the cavity 50, wherein the tabs 86 snap back into place upon completed entry of the fastener head 30 or nut 28. The fastener head 30 or nut 28 that is not in the engagement portion 34 is rotated and the elongated portion 36 of the torque retaining device 20 is prevented from unitarily rotating by engaging one of the first or second parts 22, 24. As the fastener 26 and nut 28 are tightened together, the fastener head 30 or nut 28 is spaced from the parts 22, 24 by the tabs 86 until the fastener 26 is tightened enough to flex the arms 86 into the opening 78. Next, the torque retaining device 20 may stay on the fastener head 30 or the nut 28, or it may snap out off by operation of the spacing in the opening 78, the tabs 86 breaking during tightening, or the number of tabs 86.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in other embodiments, even if not specifically shown or described. The same may also be varied in many ways. Such variations are not to be regarded as a departure from the disclosure, and all such modifications are intended to be included within the scope of disclosure.

What is claimed is:

1. A torque retaining device for preventing unitary rotation of a nut and a fastener extending through two parts to be connected comprising:

an engagement portion including a wall having an inner side defining a cavity for placement of the fastener head or nut, the inner side of the wall being shaped to rotate with the fastener head or nut;

an elongated portion having at least one sidewall extending radially outwardly from the engagement portion for rotationally catching on one of the parts that the fastener is to be extended through;

at least one flexible member extending radially inwardly from the inner side of the wall for holding the fastener head or nut in the cavity of the engagement portion; and wherein the inner side of the wall defines an opening extending radially outwardly for seating the flexible member and allowing it to flex radially outwardly.

2. The torque retaining device as set forth in claim 1, wherein the flexible member comprises an arm extending from a base seated in the opening and extending to a distal end, wherein the flexible member further includes a retaining tab located between the base and distal end and extending radially inwardly into the cavity.

3. The torque retaining device as set forth in claim 2, wherein the tab includes a first cam surface and a second cam surface each extending radially inwardly into the cavity and towards each other to define a wedge shape.

4. The torque retaining device as set forth in claim 3, wherein the engagement portion includes a flange ring axially spaced from the tab to provide an axial seat for the fastener head or nut such that when the fastener head or nut is placed against the flange ring, the second cam surface is at least partially disposed over the fastener head or nut radially and axially to retain it in the cavity.

5. The torque retaining device as set forth in claim 1, including a second flexible member disposed on a radially opposite side of the cavity as the other flexible member.

6. The torque retaining device as set forth in claim 1, wherein the at least one flexible member includes a retaining ring having an annular shape and extending radially inwardly from the cavity for axially retaining the fastener head or nut in the cavity.

7. The torque retaining device as set forth in claim 6, wherein the engagement portion is attached to the fastener head and the fastener head includes a stepped portion being annularly shaped for engagement with the retaining ring.

8. The torque retaining device as set forth in claim 1, wherein the elongated portion includes friction pads for engagement and increased rotational friction with one of the two parts.

9. A torque retaining system for preventing unitary rotation of a nut and a fastener extending through two parts to be connected comprising:

a fastener head having an exterior surface that defines an indentation extending radially inwardly;

a torque retaining device including an engagement portion and an elongated portion;

the elongated portion extending radially outwardly from the engagement portion for rotationally catching on one of the parts that the fastener is to be extended through;

the engagement portion including a wall having an inner side defining a cavity for engagement with the exterior surface of the fastener head, the inner side of the wall being shaped to rotate with the fastener head;

at least one member extending radially inwardly from the inner side of the wall into the indentation of the fastener head for holding the fastener head in the engagement portion; and wherein the fastener head includes a flange extending radially outwardly and the flange defines a bearing surface for interfacing with one of the parts, wherein the indentation includes a stepped portion defined by the flange and axially inset from the bearing portion.

10. The torque retaining system as set forth in claim 9, wherein the stepped portion is annularly disposed around the bearing portion and the member includes a retaining ring disposed in the stepped portion.

11. The torque retaining system as set forth in claim 9, wherein the engagement portion further includes a ring projection located radially outwardly and axially beyond the bearing surface of the flange for interfacing with a part and removing the retaining ring from the stepped portion during tightening.

12. A method of applying the torque retaining device to the fastener head in the torque retaining system as set forth in claim 9, wherein the torque retaining device is molded onto the fastener head.

13. The method of applying the torque retaining device to the fastener head as set forth in claim 12, further including:

providing a plurality of fasteners into a plurality of mold cavities, each mold cavity outlining the shape of the torque retaining device;

simultaneously injecting molten material into each of the mold cavities; and cooling the molten material to form torque retaining devices.

14. The method of applying the torque retaining device to the fastener head as set forth in claim 13, further including providing rubber-based molten material.

15. A torque retaining device for preventing unitary rotation of a nut and a fastener extending through two parts to be connected comprising:

an engagement portion including a wall having an inner side defining a cavity for placement of the fastener head or nut, the inner side of the wall being shaped to rotate with the fastener head or nut;

at least one flexible member extending radially inwardly from the inner side of the wall for holding the fastener head or nut in the engagement portion;

the flexible member including an arm extending to an angled cam surface for effectuating radial outward flexing of the arm as the cam surface engages the fastener head or nut; and wherein the inner side of engagement portion further includes flange ring extending radially inwardly from the cavity for axially seating and retaining the fastener head or nut in a first axial direction.

16. The torque retaining device as set forth in claim 15, wherein the flexible member further includes a second cam surface extending at an angle from the other cam surface to define a wedge shape and axially retain the fastener head or nut in a second axial direction when the fastener head or nut is in contact with the flange ring.

17. The torque retaining device as set forth in claim 15, wherein the inner side of the engagement portion further includes a circular surface for accepting a washer and an interface portion that is spaced between the flange ring and the circular surface for radially locking with the fastener head or nut.

* * * * *